United States Patent [19]

Hymo

[11] 4,131,382

[45] Dec. 26, 1978

[54] EXPANSION JOINTS

[76] Inventor: Lawrence A. Hymo, 9414 Macklin Ct., Alexandria, Va. 22310

[21] Appl. No.: 860,574

[22] Filed: Dec. 14, 1977

[51] Int. Cl.[2] ..... E01C 11/10

[52] U.S. Cl. ..... 404/69; 52/396

[58] Field of Search ..... 404/47, 68, 69, 48; 14/16.5; 52/396

[56] References Cited

U.S. PATENT DOCUMENTS

| | | | |
|---|---|---|---|
| 3,372,521 | 3/1968 | Thom | 404/47 X |
| 3,690,226 | 9/1972 | Hein | 404/68 |
| 3,977,802 | 8/1976 | Galbreath | 404/69 |
| 3,992,121 | 11/1976 | Geiger | 404/47 |
| 4,022,538 | 5/1977 | Watson | 404/69 |
| 4,033,702 | 7/1977 | Moerk | 404/69 |

*Primary Examiner*—Nile C. Byers, Jr.

*Attorney, Agent, or Firm*—Cushman, Darby & Cushman

[57] ABSTRACT

Means are provided for reducing or eliminating leakage of water around rubber cushion expansion joints in highway and bridge pavements. Molded rubber cushion joint sections which are typically 4 to 6 feet long are spaced from each other, end-to-end and a flexible membrane is fitted between the facing ends to absorb shearing stresses between adjoining sections and seal the end-to-end connections. In addition, a hollow rubber tube is compressed between the sections and the pavement to seal against leakage around the joint sections.

6 Claims, 5 Drawing Figures

EXPANSION JOINTS

The present invention relates to expansion joints for bridges and highways, of the rubber cushion type, comprising molded rubber units, typically 4–6 feet long. The invention provides improvements which increase the ability of such units to prevent seepage of moisture from the roadway surface onto underlying structures.

Expansion joints of the type described above are characterized by a substantial thickness of rubber, usually reinforced to increase the stiffness of the rubber so that it can support the weight of traffic. Examples of such expansion joints are disclosed for instance in the following U.S. Pat. Nos. 4,022,538, 3,165,986, 3,165,987, 3,273,473, 3,316,574, 3,331,294, 3,363,522, 3,555,982, U.S. Pat. No. Re. 26,733, U.S. Pat. Nos. 3,690,226, and 3,713,368.

Because of the size of such joints, they normally must be manufactured by molding rubber as distinguished from extrusion. Owing to practical limitations on the size of rubber molding equipment, it is possible to manufacture expansion joints of the rubber cushion type in only relatively short lengths. At present, 4 and 6 foot units are typical, and there have been proposals to manufacture 12 foot units. On the other hand, highways usually are much wider. For example, interstate highways in the United States generally have several lanes, each 12 feet wide. As a consequence, it is necessary to connect several rubber cushion joint units together end-to-end, to provide a joint which extends the full width of the bridge or highway.

Various adhesives have been evaluated, and it is common to provide tongue and groove connections at the ends of the units. However, the foregoing joints have exhibited inadequate sealing at the end-to-end connections between rubber cushion expansion joint units, which results in leakage of water and de-icing chemicals from the roadway surface onto supporting structures. In some locations, units have been vulcanized to each other which provides a stronger bond between the units, but vulcanization, especially at a construction site, is difficult and expensive.

A second problem which arises in connection with rubber cushion joints involves leaking of water around and under the units. The units ordinarily are bolted into rectangular recesses (called blockouts) formed in a roadway adjacent the expansion gap which the joint is designed to cover. In the case of concrete roadways, the blockout is formed during construction. In the case of asphalt overlay work, the blockout is formed by anchoring the rubber cushion expansion joint to a concrete roadway and then overlaying asphalt on the concrete, up to the surface of the expansion joint. Because the concrete surface is not completely smooth and even, the rubber cushion expansion joint does not form a watertight connection with the pavement. Consequently, it has been common to apply liquid sealing materials or soft rubber under and around the rubber cushion unit to try to prevent leaking. However, leakage occurs nevertheless. The risk of leakage is increased because the units are usually bolted to the roadway. Any loss of torque on the bolts loosens the expansion joint units and reduces the compression of whatever sealants have been applied.

The present invention relates to improvements which are designed to reduce substantially the risk of leakage of rubber cushion expansion joints. It is based on the premise that it is better to assume that the expansion joint units cannot be connected to each other and to the roadway by a durably rigid connection, and that the connections are subject to shearing forces caused by vehicles passing over the units. Therefore the invention provides sealing connections between the respective units and between the units and the roadway which absorb shearing forces without loss of sealing.

The preferred embodiments of structures which perform these functions are described below, reference being made to the drawings, in which.

Figure 1:
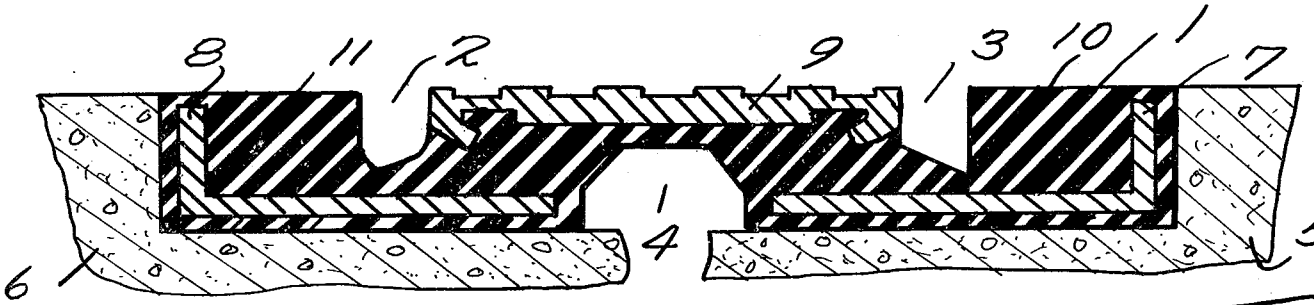
FIGS. 1 and 2 are transverse cross-sections of typical rubber cushion expansion joints.

Referring to FIG. 1, the expansion joint comprises a block of rubber provided with grooves 2, 3 and 4 which absorb compression and allow for expansion of the joint during thermal movement of the adjoining concrete structures 5 and 6. The unit is reinforced with steel angles 7 and 8 and an aluminum plate 9 as described in U.S. Pat. No. 4,022,538. Typically bolts extend upwardly from the pavement into bolt cavities 109 (see FIG. 5) located at 1 foot intervals along the units in the areas indicated by the numerals 10 and 11, which are secured by nuts tightened against the angles 7 and 8. At the ends of the units, the angles 7 and 8 and the plate 9 are terminated leaving an end covering of rubber, for example ¼ inch thick.

Figure 2:
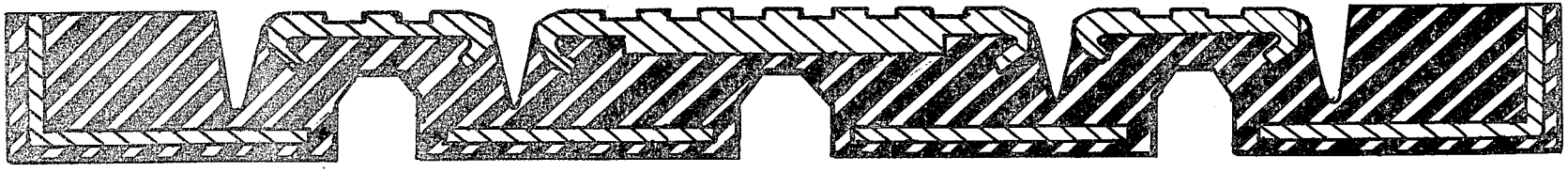

The embodiment of FIG. 2 is of similar design except that it is wider and is provided with seven grooves, allowing for a larger amount of movement.

Figure 3:
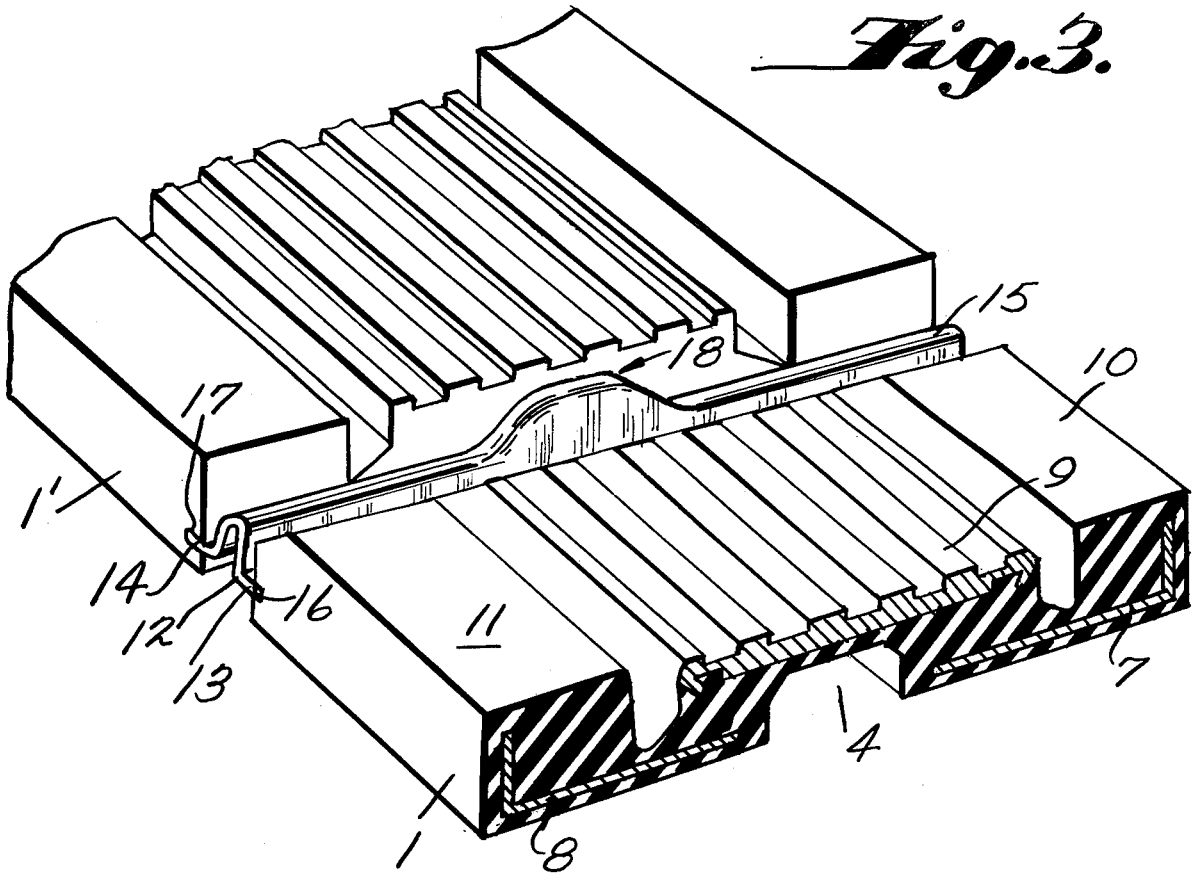
FIG. 3 is a perspective view illustrating the end-to-end connection between the rubber cushion units.

FIG. 3 illustrates a unit similar in cross-section to the unit illustrated in FIG. 1, showing an end-to-end connection in accordance with the invention. The connection consists of a rubber strip 12 having a pair of side members 13 and 14 joined by an upstanding arch 15. Preferably the strip 12 is made of neoprene or other weather-resistant rubber compound. The rubber cushion units 1 and 1' are provided with grooves 16 and 17 in their end faces which receive the side members 13 and 14. A suitable adhesive can be used to hold the rubber strip in those grooves. Alternatively, the strip may be molded as an integral part of one of the units and installed in a groove in the end of the adjoining unit.

The strip 12 is shaped to fold up over the groove 4 which is cut into the lower surface of the rubber cushion joint, as seen at 18. Since this involves a two directional folding of the strip 12, it is preferable that the strip 12 is molded to the desired shape.

The strip 12 can flex to absorb any shearing movements between the units 1 and 1', for example, when a vehicle passes over one of them, depressing that unit relative to the next adjoining unit. Consequently there is little if any stress applied to the connection between the strip 12 and the units 1 and 1', thereby minimizing the possibility of leaks developing.

Figure 4:
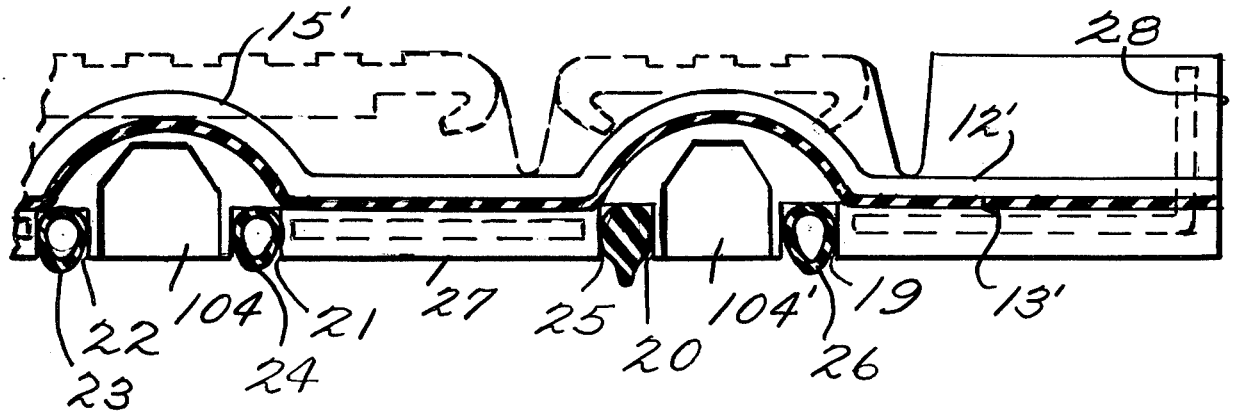
FIG. 4 is a cross-section of a portion of a rubber cushion unit similar to FIG. 2, taken through the end-to-end connection, illustrating also shear-absorbing means to seal the connection between the units and the pavement.

Another aspect of the invention is seen in FIG. 4, which illustrates a unit similar to the unit illustrated in FIG. 2. In this case, the strip 12' connects adjoining units, end-to-end, using an upstanding arch 15' to absorb shearing movements and side member 13' for connection to the rubber cushion unit. In this embodiment, grooves 19, 20, 21 and 22 are provided in the lower surfaces of the units adjacent the expansion grooves 104 and 104'. In grooves 19, 21 and 22 there are installed compressible rubber tubes 23, 24, and 26. the tubes are initially of circular cross-section, but they are larger than the grooves so that the tubes are compressed when installed and project below the bottom surface 27 of the rubber cushion unit. Consequently, when installed as illustrated in FIG. 1, the tubes 23–26 provide a seal between the rubber cushion unit and the roadway. Another embodiment is illustrated at groove 25 in which a strip of solid rubber is installed which is provided with a depending longitudinal fin of flexible rubber which extends below surface 27 and presses against the roadway.

Figure 5:
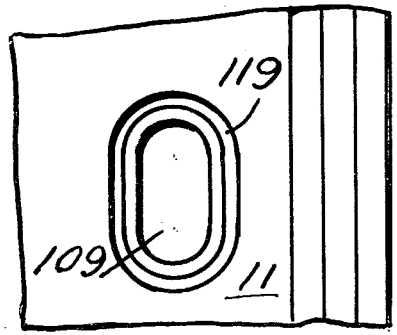
FIG. 5 is a view from below of a portion of the expansion joint illustrated in FIG. 3.

A similar construction can be used in the form of a compressible washer in a groove 119 around bolt hole 109 in the lower surface as shown in FIG. 5. In this case, in lieu of a hollow tube as illustrated in FIG. 4, a flexible foamed plastic ring may be used, molded to the precise shape required. Similarly, sealing strips can be installed along outer surface 28.

The strip 12 and the sealing elements 23, 24, 25 and 26 are constructed to allow shearing movement between adjoining rubber cushion units and between the units and the pavement, and prevent seepage of water. Therefore, they can aleviate most if not all leakage problems associated with installation of rubber cushion expansion joints.

I claim:

1. In a roadway expansion joint comprising first and second adjoining pavement sections, spaced from each other to provide a gap therebetween, each said pavement section having a blockout adjacent said gap, said blockout opening upwardly and toward said gap to receive an expansion joint, a rubber cushion expansion joint comprising a plurality of elongated units, each said unit comprising first and second elongated rubber cushion, each said rubber cushion having a top surface, a bottom surface, an outer surface and end surfaces, said rubber cushion units being secured respectively in said blockouts on opposite sides of said gap so that the top surfaces of said rubber cushions form part of the roadway surfaces, and means connecting said rubber cushions, said connecting means forming a watertight connection between said rubber cushions and allowing movement of said rubber cushions toward and away from each other to accommodate opening and closing of said gap, said plurality of units being secured in said blockouts in end-to-end relationship along the length of said expansion joint, and end-to-end connecting means which connect the ends of adjoining units along said expansion joint;

the improvement wherein the end surfaces of adjoining rubber cushions are spaced from each other and said end-to-end connecting means comprises flexible sealing means spanning the space between facing end surfaces of adjoining rubber cushions, whereby said end-to-end connecting means absorb shearing forces imposed between adjoining units by traffic and seal the end-to-end connections against leakage.

2. In a roadway expansion joint comprising a first and second adjoining pavement section, spaced from each other to provide a gap therebetween, each said pavement section having a blockout adjacent said gap, said blockout opening upwardly and toward said gap to receive an expansion joint, a rubber cushion expansion joint comprising a plurality of elongated units, each said unit comprising first and second elongated rubber cushions, each said rubber cushion having a top surface, a bottom surface, an outer surface and end surfaces, said rubber cushion units being secured respectively in said blockouts on opposite sides of said gap so that the top surfaces of said rubber cushions form part of the roadway surfaces, and means connecting said rubber cushions, said connecting means forming a watertight connection between said rubber cushions and allowing movement of said rubber cushions toward and away from each other to accommodate opening and closing of said gap, said plurality of units being secured in said blockouts in end-to-end relationship along the length of said expansion joint, and end-to-end connecting means which connect the ends of adjoining units along said expansion joint;

the improvement wherein said rubber cushions have a longitudinally-extending groove in their bottom or outer surfaces and including a flexible sealing member in said groove and extending outwardly into contact with said blockout to seal against leakage of water.

3. A roadway expansion joint as set forth in claim 2 in which said flexible sealing member is a hollow compressible rubber tube.

4. A roadway expansion joint as set forth in claim 2 in which said flexible sealing member is a strip of solid rubber.

5. A roadway expansion joint as set forth in claim 2 in which said rubber cushions are provided with vertical holes which receive bolts to secure them to said blockouts, and including flexible sealing members extending downwardly from the bottoms of the rubber cushions in loops around said bolt holes, to seal against leakage through said bolt holes.

6. In a roadway expansion joint as set forth in claim 2 the further improvement wherein the end surfaces of adjoining rubber cushions are spaced from each other and said end-to-end connecting means comprises flexible sealing means spanning the space between facing end surfaces of adjoining rubber cushions, whereby said end-to-end connecting means absorb shearing forces imposed between adjoining units by traffic.

* * * * *